US005118960A

United States Patent [19]

Sasamoto et al.

[11] Patent Number: 5,118,960

[45] Date of Patent: Jun. 2, 1992

[54] STARTER DEVICE

[75] Inventors: Hisaya Sasamoto, Mito; Kazuo Tahara, Hitachi, both of Japan

[73] Assignee: Hitachi, Ltd., Tokyo, Japan

[21] Appl. No.: 704,929

[22] Filed: May 23, 1991

[30] Foreign Application Priority Data

May 30, 1990 [JP] Japan ..... 2-138222

[51] Int. Cl.[5] ..... F02N 11/00

[52] U.S. Cl. ..... 290/48; 290/38 R; 290/38 C

[58] Field of Search ..... 290/38 R, 38 A, 38 C, 290/48, DIG. 1

[56] References Cited

U.S. PATENT DOCUMENTS 5,023,466 6/1991 Isozumi ..... 290/48

FOREIGN PATENT DOCUMENTS 85574 9/1986 Japan .

*Primary Examiner*—A. D. Pellinen
*Assistant Examiner*—Robert L. Hoover
*Attorney, Agent, or Firm*—Antonelli, Terry, Stout & Kraus

[57] ABSTRACT

An electromagnetic push-out unit which controls engagement and disengagement between a pinion gear and a ring gear for an engine in a starter device via a non-magnetic cylindrical member disposed concentrically with a pinion shaft mechanically coupled to an electrical motor. The electromagnetic push-out unit is concentrically disposed around the cylindrical member and comprises an electromagnetic coil, a stationary core for the electromagnetic coil, a movable core facing to the pole face of the stationary core and forming a magnetic circuit together with the stationary core via a first air gap and a bridge member extending along the moving direction of the movable core, magnetically coupled thereto and facing to the stationary core with a second air gap shorter than the first air gap thereby a part of the magnetic flux in the magnetic circuit bypasses through the bridge member to increase magnetic traction force acting between the stationary core and the movable core at the start of the travel of the movable core and to suppress the increase of the magnetic traction force at the end of the travel thereof.

17 Claims, 8 Drawing Sheets

FIG. 6
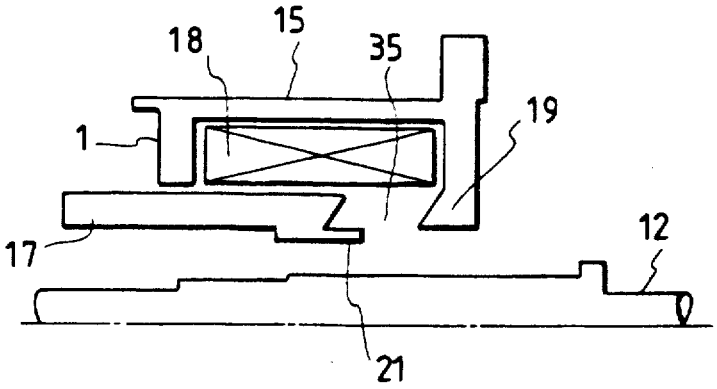
FIG. 7
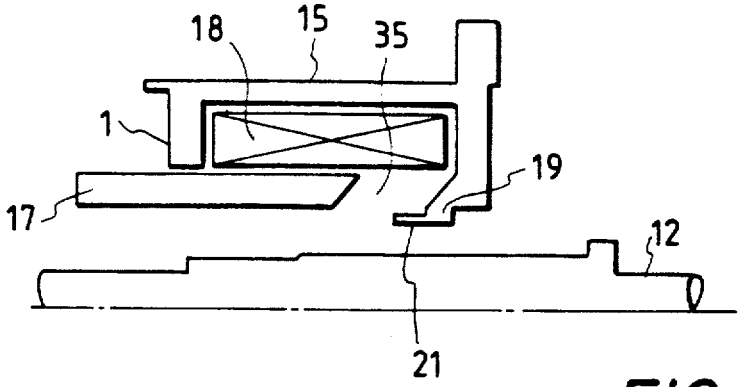
FIG. 8A
FIG. 8
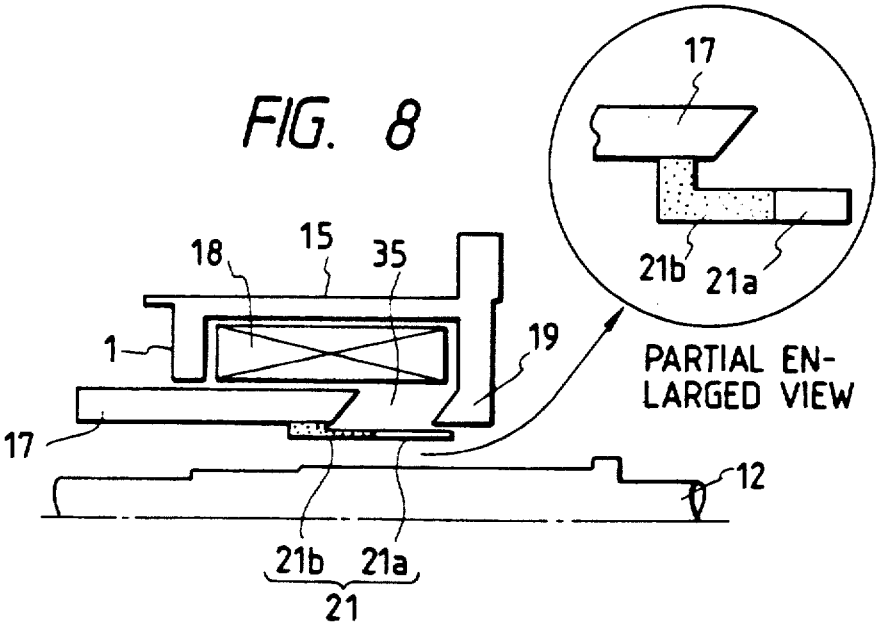

STARTER DEVICE

BACKGROUND OF THE INVENTION

The present invention relates to a starter device which transmits rotational torque to an engine in a motor vehicle for starting thereof.

A starter device for a motor vehicle is constituted in such a manner that its motor unit transmits rotational movement to the pinion gear supported on the pinion shaft and as well its electromagnetic push-out unit displaces the pinion gear. Through the displacement of the pinion gear, the pinion gear couples the ring gear of an engine in a motor vehicle, thereby the rotational movement of the motor unit is transmitted to the engine.

In a conventional starter device, the pinion shaft, on one hand, was arranged on substantially the same axis as that of the motor unit and, on the other hand, the electromagnetic push-out unit was arranged parallel with the motor unit. Thus the electromagnetic push-out unit displaces the pinion gear via a shaft lever. For this reason, the enitre structure of this kind of starter device was awkward and its installation space in the engine room was limited so that the proper arrangement thereof in the engine room was one of difficult problems, further such structure could not meet the current demmand for a high density installation of the motor vehicle components in the engine room.

For solvent the above problem and fulfilling the above demmand, so called starter device with a common axis type electromagnetic push-out unit was proposed wherein the electromagnetic push-out unit was constructed in a cylindrical shape and was concentrically disposed around the circumference of a pinion shaft. One of the examples of these starter devices is disclosed in JP-A-61-85574 (1986).

The above starter device directly transmits the displacement of the electromagnetic push-out unit to the pinion gear without using a shift lever. Therefore, the displacement of the pinion gear with respect to the displacement of the electromagnetic push-out can not be adjusted such as by pivotally supporting the center of the shift lever.

Generally, the electromagnetic push-out unit includes therein a magnetic circuit wherein the displacement caused by the electromagnetic push-out is obtained by magnetic traction force of the movable core toward the stationary core. However, as explained above, when the displacement of the pinion gear could not be adjusted with respect to the displacement of the electromagnetic push-out unit, the amount of displacement of the movable core could not be reduced, therefore a long magnetic resistance portion had to be included in the magnetic circuit in the electromagnetic push-out unit. For this reason, the magnetic field generated by the electromagnetic coil portion in the electromagnetic push-out unit had to be increased to thereby enlarging the size of the electromagnetic coil and as a result the entire size of the starter device was accordingly enlarged.

The magnetic traction force acted upon between the stationary core and the movable core varies dependent upon the square of their gap variation such that the magnetic traction force exponentially increases as the movable core is attracted by the stationary core and approaches thereto. On one hand, the movable core is energized by a return spring so as to return the movable core to the initial position when the current supply from the electromagnetic coil is interrupted. Herein, the energizing force of the return spring varies in proportion to the gap variation between the movable core and the stationary core.

In the starter device with a so called coaxial type electromagnetic push-out unit, since the the distance of displacement of the movable core was increased as indicated above, thereby the gap between the movable core and the stationary core was also increased so that the magnetic traction force was rather increased relative to the return spring force. For this reason, the mechanical strength of the respective mechanical elements in the electromagnetic push-out unit had to be increased and further the structure thereof was complexed which increased the size of the starter device itself.

SUMMARY OF THE INVENTION

In view of the above problems, an object of the present invention is to provide a starter device which enables to reduce the total size thereof while permitting coaxial arrangement of an electromagnetic push-out unit around the circumference of a pinion shaft.

The above object of the present invention is achieved by introducing a magnetic bridge member in the magnetic circuit of the electromagnetic push-out unit wherein the distance from the top of the magnetic bridge member to the magnetic pole of the stationary core in the magnetic circuit is selected shorter than that from the movable core to the magnetic pole of the stationary core when no current supplied to the electromagnetic coil and further a part of the magnetic flux generated, when the magnetic coil is energized, and passing through the movable core is conveyed through the magnetic bridge member to the stationary core.

Further, the above object of the present invention is achieved by providing a magnetic bridge member in the magnetic circuit of the electromagnetic push-out unit which bypasses a part of the magnetic flux passing through the movable core toward the stationary core when the movable core displaces a predetermined distance.

Still further, the above object of the present invention is achieved by forming a cylindrical member connected to the movable core for displacing the pinion gear from a non-magnetic material.

According to the measures of the present invention as indicated above, the magnetic circuit is constituted in such a manner that a part of the magnetic flux passing through the movable core reaches to the stationary core via the magnetic bridge member so that the air gap distance of the magnetic poles of the movable core and the stationary core is shortened and the magnetic resistance of the magnetic circuit is reduced.

Therefore, the magnetic field generated by the magnetic coil is effectively ulilized so that member of turns of the electromagnetic coil is reduced and the size of the entire starter device is reduced.

Further, according to the measures of the present invention as indicated above, the magnetic bridge member bypasses a part of the magnetic flux passing through the movable core to convey thereof to the stationary core.

Because the magnetic bridge member functions as explained above, when the gap between the movable core and the stationary core is reduced below a predetermined distance, the magnetic traction force acting between the movable core and the stationary core is reduced. Thereby, the level of the mechanical strength of the electromagnetic push-out unit is maintained low, such that constitutional elements with low mechanical strength are applicable and the size of the entire starter device is reduced.

Still further, according to the measures of the present invention as indicated above, because the cylindrical member connected to the movable core for displacing the pinion gear is made of non-magnetic material, no magnetic flux passing through the movable core and the stationary core leaks into such as the cylindrical member and the magnetic flux generated by the magnetic coil is effectively utilized. Therefore, the number of turns of the electromagnetic coil is reduced and the size of the entire starter device is reduced.

BRIEF DESCRIPTION OF THE DRAWINGS

FIG. 6 is a view showing an electromagnetic push-out unit according to the present invention;

FIG. 7 is a view showing another electromagnetic push-out unit according to the present invention;

FIG. 8 is a view showing a further arrangement of an electromagnetic push-out unit according to the present invention with FIG. 8A showing a portion in enlarged view;

DETAILED EXPLANATION OF THE PREFERRED EMBODIMENTS

Figure 1:
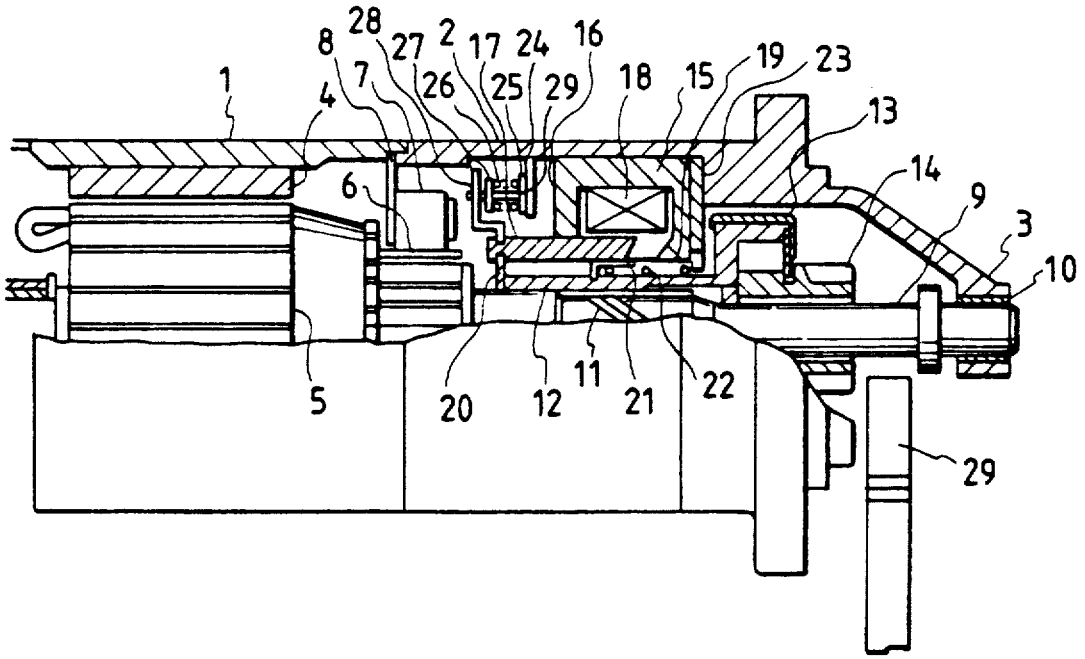
FIG. 1 is a view showing a starter device according to the present invention.

Hereinbelow, one embodiment of the present invention is explained with reference to the drawings. FIG. 1 shows a closed type starter device. To the front end of a housing 1 at a motor side constituted by magnetic material a housing 2 at an electromagnetic coil side constituted by non-magnetic material is connected.

Around the inner circumferential face of the housing 1 at the motor side field poles 4 of permanent magnet, for example four poles, are secured with an equal interval. Further, an armature 5 is received inside the motor side housing 1 so as to oppose the field poles of permanent magnet. Still further, a commutator 6 is constituted in a part of the amarture 5.

Further, brushes 7 are secured via brush holders 8 to the inside of the motor side housing 1. The brushes 7 are contacted to the commutator 6 with a prooer spring force, so that current is supplied to the armature ciol in the armature 5 via the brushes 7 and the commutator 6.

To the front end of the armature 5 a pinion shaft 9 is connected. The armature 5 and the pinion shaft 9 are integrally connected and rotatably supported at its front end via a bearing 10 provided at a pinion gear case 3 and at its rear end via a bearing (not shown) provided at the back of the armature 5.

In a part of the pinion shaft 9 a helical spline 11 is provided. Further, around the outer circumference of the pinion shaft 9 a cylindrical member 12 constituted by non-magnetic material is disposed. On the inner circumferential face of the cylindrical member 12 a helical spline is provided. Via the helical spline 11 provided at the pinion shaft 9, the cylindrical member 12 is adapted to be slidable with respect to the pinion shaft 9 and as well the rotation of the pinion shaft 9 is adapted to be transmitted to the cylindrical member 12.

At the front end of the cylindrical member 12 a one way clutch 13 is provided. Further, at the front end of the clutch a pinion gear 14 is disposed. The one way clutch 13 is for transmitting the rotation of the cylindrical member 12 to the pinion gear 14 and at the same time effects to release the coupling between the cylindrical member 12 and pinion gear 14 when reverse torque is generated at the pinion gear 14.

On the inner circumferential side of the electromagnetic coil side housing 2 an electromagnetic push-out unit 15 is disposed. The electromagnetic push-out unit 15 is composed of a stationary core 16, a movable core 17 and an electromagnetic coil 18. The stationary core 16 is in a cylindrical form and the cross sectional form into its axial direction is a reversed U shape, in another aspect the configuration of the stationary core 16 is obtained by rotating the above reversed U shaped body around the axis of the unit while contacting the bottom of the reversed U shaped body onto the inner face of the electromagnetic coil side housing 2. Inside the stationary core 16 the electromagnetic coil 18 of a cylindrical shape is accommodated. Further, the front end extention toward the axis of the stationary core 16 is designed longer that the rear end extension thereof, and the end portion of the longer extension opposing to the movable core 17 constitutes a magnetic pole 19. A part of the opening of the stationary core 16 is occupied by the movable core 17 of a cylindrical shape and movable into the axial direction. In this constitution, the stationary core 16 and the movable core 17 form a magnetic circuit via an air gap for the magnetic field generated by the electromagnetic coil 18. Therefore, when magnetic field is generated, the movable core 17 and the magnetic pole 19 of the stationary core 16 are mutually attracted.

The movable core 17 is connnected to the cylindrical member 12 via a coupling member 20, the amount of displacement of the movable core 17 is transferred without change to the displacement of the pinion shaft 9.

A cylindrical shaped bridge member 21 is disposed around the inner circumferential side of the movable core 17 and adjacent thereto. The bridge member 21 is further arranged in substantially parallel to the movable core 17 and is still further disposed in such a manner that the distauce from the top end of the bridge member to the magnetic pole 19 is shorter than that from the top end of the movable core 17 to the magnetic pole 19. The rear end portion of the bridge member 21 is bent and connected to the cylindrical member 12. Therefore, the amount of displacement of the bridge member 21 is as same as that of the cylindrical member 12 and of the movable core 17. Further, between the bent portion of the bridge member 21 and a side plate provided at the rear end of the pinion gear case 3 a return spring 22 is disposed so as to force the pinion shaft 9 toward its rear end direction.

A switch 24 is disposed at the back of the stationary core 16. The switch 24 is constituted by a stationary contact 25 and a movable contact 27. The stationary contact 25 is secured on the electromagnetic coil side housing 2. Further, a through shaft 29 is coupled to the stationary contact 25. The movable contact 27 is energized by a pressing spring 26, and is slidably held along the through shaft 29 while supporting one end of the pressing spring 26 by a stopper member 28 secured to the cylindrical member 12.

When the movable contact 27 and the stationary contact 25 are contacted, electric current is supplied to the armature coil of the armature 5 via the commutator 6 and the brush 7. Further, the pressing spring 26 is provided in insulated relation from both the movable contact 27 and the stationary contact 25 for separating one from the other by its spring force when an engine start switch not shown is turned off. The through shaft 29 is provided for smoothly displacing the movable contact 27 and is also passed through the stopper member 28 connected to the movable core 17. The fitting of the through shaft 29 into the hole in the stopper member 28 works to prevent rotation of the movable core 17 even if the cylindrical member 12 rotates.

Since a rotation preventing mechanism for the movable core 17 is constituted between the through shaft 29 provided at the switch 24 and the stopper member 28 provided at the movable core 17, the entire portions of the movable core 17 are effectively used for the magnetic flux passage in comparison with a movable core with a key groove to prevent rotation thereof, which serves size reduction of the starter device.

Hereinbelow, the operation of this embodiment is explained.

When the engine start switch not shown is turned on, electrical current is supplied to the electromagnetic push-out unit 15. Thereby, the electric current flows through the electromagnetic coil 18 to generate magnetic field therearound, and the magnetic flux due to the magnetic field passes through the magnetic circuit formed by the stationary core 16 and the movable core 17.

When the engine start switch is not turned on, the cylindrical member 12 is pushed backward via the return spring 22, and a gap is formed between the magnetic poles of the stationary core 16 and the movable core 17. When the magnetic flux passes through the magnetic circuit constituted by the stationary core 16 and the movable core 17, an attraction force is induced between the stationary core 16 and the movable core 17 and the movable core 17 displaces toward the forward direction against the elastic force of the return spring 22 (rightward direction in FIG. 1).

The displacement force of the movable core 17 is transmitted to the cylindrical member 12 via a coupling member 20 and in association with the displacement of the movable core 17 the cylindrical member 12 displaces and as well the pinion gear 14. Since the helical spline 11 is provided inside the cylindrical member 12, the cylindrical member 12 displaces therethrough while rotating slowly. Thus constituting, the pinion gear 14 touches to the ring gear 29 of the engine while rotating slowly and thereby facilitating the engagement of the pinion gear 14 to the ring gear 29. Therefore, when the cylindrical member 12 displaces forward, the side face of the pinion gear 14 touches to the face of the ring gear 29 which directly couples to the crank shaft, and thereafter, the pinion gear 14 engages with the ring gear 29.

On the other hand, the displacement of the movable core 17 is transmitted to the movable contact 26 of the switch 24 via the stopper member 28 and the movable contact 26 displaces in association with the displacement of the movable core 17. The location of the pinion gear 14 and the ring gear 29 is determined such that when the pinion gear 14 displaces to the position where the pinion gear 14 engages to the ring gear 29, the movable contact 26 touches to the stationary contact 25 to electrically short-circuiting therebetween. Through this short circuiting electric current is supplied to the armature coil of the armature 5 via brushes 7 and the commutator 6. When the electric current flows through the armature coil in the armature 5, electromagnetic force is generated by the effect of the magnetic flux induced by the field poles 4 to thereby generate rotating torque in the armature 5.

The rotating effort of the armature 5 is transmitted to the pinion gear 14 via the pinion shaft 9, the cylindrical member 12 and the one way clutch 13. Thereby, the pinion gear 14 rotates the ring gear 29 and therefore starts the engine.

When the start of the engine is completed, the engine start switch not shown is turned off and further the current supply to the electromagnetic push-out 15 is interrupted, and the generation of the magnetic field by the electromagnetic coil 18 is ceased. Thereby the attraction force acted between the movable core 17 and the stationary core 16 disappears so that the cylindrical member 12 displaces backward direction by the energizing force of the return spring 22 (leftward direction in FIG. 1). In response thereto, the pinion gear 14 is released from the coupling with the ring gear 29.

Further, at the same time, the current supply to the armature coil in the armature 5 is interrupted and the rotation of the armature 5 is stopped.

Now, the electromagnetic push-out unit 15 is explained in detail.

When electric current is supplied to the electromagnetic coil 18 and magnetic field is induced, magnetic flux due to the magnetic field passes through the magnetic circuit formed by the stationary core 16 and the movable core 17 via the air gap between the magnetic pole 19 of the stationary core 16 and the movable core 17.

Figure 2A:
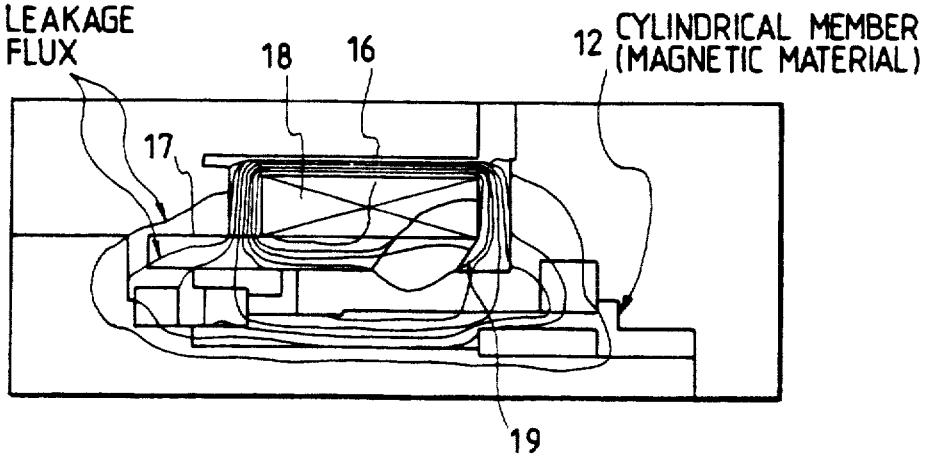
FIG. 2(*a*), FIG. 2(*b*) and FIG. 2(*c*) are diagrams showing magnetic flux distribution in magnetic circuits of a conventional electromagnetic push-out unit and of the present invention.
Figure 2B:
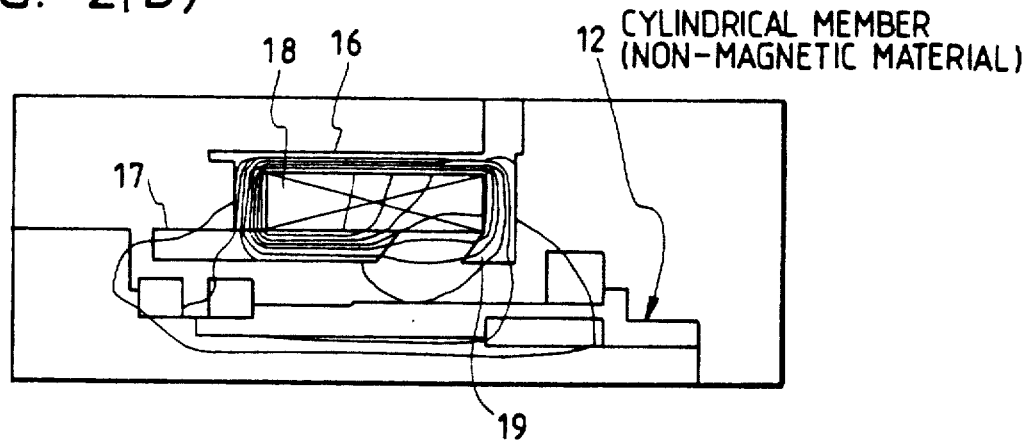
Figure 2C:
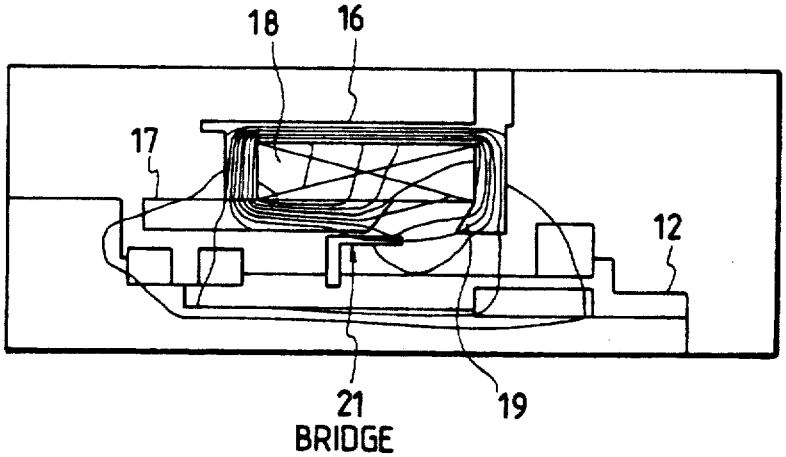

Now, when the cylindrical member 12 is made of a magnetic material as indicated by FIG. 2(*a*), the magnetic flux due to the magnetic field induced by the electromagnetic coil 18 passes through the cylindrical member 12. Therefore, the part of the magnetic flux induced by the electromagnetic coil 18 leaks outof the stationary core 16 and the movable core 17 to reduce the magnetic flux passing therethrough. In other words, the magnetic traction force between the stationary core 16 and the movable core 17 reduces which is caused when electric current is supplied to the electromagnetic coil 18.

For this reason, for obtaining a predetermined electromagnetic traction force for a specific design of the electromagnetic push-out unit 15, it is necessary to increase the number of turns of the electromagnetic coil 18 and to increase the strength of the magnetic field induced by the electromagnetic coil 18. Accordingly, the size of the electromagnetic coil 18 is necessarily increased so that the size and weight of the electromagnetic push-out unit 15 is increased and in addition thereto the power consumption thereof is also increased.

Further, in general, the diameter of the starter device is preferably to be uniform in view of its installation freedom. Therefore, it is required to select the same outer diameter of the magnetic coil side housing 2 accommodating the electromagnetic push-out unit 15 as that of the motor side housing 1 so that the length into the axial direction of the starter device is necessarily elongated in order to increase the number of turns of the electromagnetic coil 18.

Contrary thereto, when the cylindrical member 12 is made of a non-magnetic material as indicated by FIG. 2(*b*), the magnetic flux due to the magnetic field induced by the electromagnetic coil 18 is hard to flow through the cylindrical member 12. Further at the same time the magnetic flux is hard to flow through the pinion shaft 9 disposed inside the cylindrical member 12. Therefore, the reduction of magnetic flux flowing through the stationary core 16 and the movable core 17 is prevented, and the magnetic field induced by the electromagnetic coil 18 is effectively utilized.

Namely, the necessary magnetic traction force between the stationary core 16 and the movable core 17 is obtained without enlarging the size of the electromagnetic coil 18.

In general, the magnetic traction force between the stationary core 16 and the movable core 17 reduces in inverse propotion to the square of the gap distance between the stationary core 16 and the movable core 17. When the engine start switch is turned on, the movable core 17 displaces against the energizing force of the return spring 22. The elastic force of the return spring is determined by the design specification so that when the distance between the stationary core 16 and the movable core 17 increases, the number of turns of the electromagnetic coil 18 has to be increased, moreover it has to be increased exponentially in accordance with the distance.

In the present embodiment, as shown in FIG. 2(*c*), a bridge member 11 is provided which is disposed near the movable core 17 inside thereof with a slight clearance and substantially in parallel thereto.

Further, the distance from the top of the bridge member 21 to the magnetic pole 19 of the stationary core 16 is determined shorter than that from the top of the movable core 17 to the magnetic pole 19 of the stationary core 16.

Therefore, one part of the magnetic flux flowing through the movable core 17 directly transferred to the stationary core 16 and the remaining part thereof is transferred via the bridge member 21 to the stationary core 16 so that an electromagnetic traction force acting between the bridge member 21 and the magnetic pole 19 of the stationary core 16 is generated in addition to the electromagnetic traction force acting between the movable core 17 and the magnetic pole 19 of the stationary core 16. Moreover, since the distance between the bridge member 21 and the magnetic pole 19 is shorter than that between the movable core 17 and the magnetic pole 19, a sufficiently large electromagnetic traction force is obtained between the bridge member 21 and the magnetic pole 19.

As will be apparent above, by the provision of the bridge member 21, the electromagnetic traction force induced by the electromagnetic push-out unit 15 is increased, thereby, the magnetic field to be induced by the electromagnetic coil 18 is reduced and the number of turns of the electromagnetic coil 18 is decreased.

Figure 3:
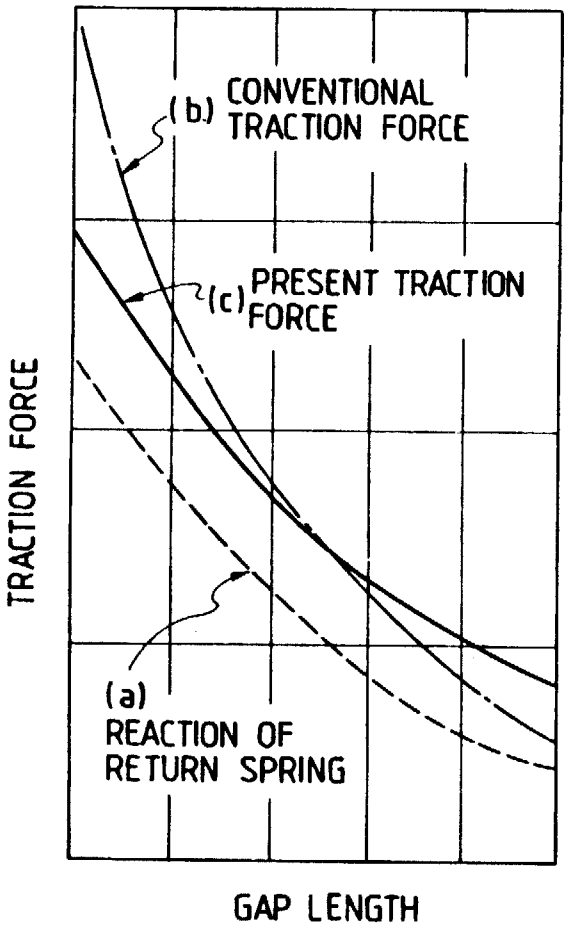
FIG. 3 is a graph for explaining characteristics of a conventional electromagnetic push-out unit and of the present invention.

Now, the electromagnetic push-out unit 15 is further explained with reference to the function of the return spring 22. As indicated above, the magnetic traction force between the stationary core 16 and the movable core 17 substantially decreases in inverse proportion to the square of the air gap distance between the stationary core 16 and the movable core 17. This magnetic traction force is plotted as shown by the curve (b) in FIG. 3. In FIG. 3, the ordinate shows magnetic traction force and the abscissa shows the distance between the stationary core 16 and the movable core 17 varying from the minimum to the maximum. On the other hands, the energizing force of the return spring 22 substantially linearly decreases in dependence upon the air gap length between the stationary core 16 and the movable core 17.

In order that the electromagnetic push-out unit 15 pushes forward the pinion shaft 9 to engage the pinion gear 14 with the ring gear 29, it is necessary to set the electromagnetic traction force between the stationary core 16 and the movable core 17 larger than the reaction force of the return spring 22 when electric current flows through the electromagnetic coil 18 in the electromagnetic push-out unit 15.

In the electromagnetic push-out unit with the traction force characteristic as shown by the curve (b) in FIG. 3, when the air gap distance changes from a larger air gap to a small air gap, the pressure of the return spring 22 proportionally increases, contrary thereto, the magnetic traction force exponentially increases. For this reason, as will be apparent from the comparison with the curves (b) and (c) in FIG. 3, when the magnetic traction force at the instance of a large air gap (when the pinion gear 14 is not coupled to the ring gear 29) is set larger than the reaction force of the return spring, the magnetic traction force at the instance of a small air gap (when the pinion gear 14 is coupled to the ring gear 29) becomes excessively larger than the reaction force of the return spring. As a result, when the air gap length between the stationary core 16 and the movable core 17 becomes sufficiently small, the electromagnetic push-out unit 15 is subjected to unduely large mechanical load. Thereby, the respective mechanical elements in the electromagnetic push-out unit 15 have to be strengthened for their mechanical damages such as by increasing the strength of a return spring stop mechanism.

In the present embodiment, different from the above, the magnetic traction force which increases in proportion to the decrease of the air gap length between the stationary core 16 and the movable core 17 is obtained as shown in the curve (c) of FIG. 3, of which detail is explained below. As shown in FIG. 2 (c), the bridge member 21 is provided in parallel to the movable core 17 with a small gap. This bridge member 21 is connected to the cylindrical member 12 and displaces therewith.

When electric current flows through the electromagnetic coil 18, magnetic traction force is generated between the stationary core 16 and the movable core 17 to reduce the distance therebetween. Further, as the gap distance decreases, the magnetic traction force increases. However, when the distance between the stationary core 16 and the movable core 17 decreases below a predetermined distance, a part of the bridge member 21 overlaps with the side face of the magnetic pole 19 of the stationary core 16. Therefore, a part of the magnetic flux which has served for inducing the magnetic traction force between the stationary core 16 and the movable core 17 in their axial direction is bypassed via the bridge member 21, and the bypassed magnetic flux flows in through the inside surface of the stationary core 16 thereby to reduce the magnetic traction force.

When the overlapping degree of the bridge member 21 and the stationary core 16 increases, bypassing amount of the magnetic flux which has served for inducing the magnetic traction force into the axial direction of the stationary core 16 and the movable core 17 increases. Accordingly, the reduction rate of the magnetic traction force therebetween increases, thereby the exponential increase of the magnetic traction force which has been caused when the air gap distance between the stationary core 16 and the movable core 17 becomes short is prevented, and the amount of the magnetic traction force is controlled to increase proportionally not exponentially as the gap distance decreases.

Namely, by the provision of the bridge member 21, the magnetic traction force within a small air gap range does not unduely increases in comparison with the reaction force of the return spring. Thus, as seen from the curves (a) and (c) in FIG. 3, the magnetic traction force characteristic shows a tendency to match with the reaction force characteristic of the return spring over the entire air gap length, and the attraction of the movable core 17 with a unnecessarily large magnetic traction force during the small air gap range is avoided so that the mechanical overload in the electromagnetic push-out unit is eliminated and the life of the starter device is prolonged.

Hereinbelow, the effects of the thickness of the bridge member 21 are explained. Generally, the upper limit of the magnetic flux which can be passed through the bridge member 21 is determined by the thickness thereof. Namely, even if there exists a large magnetic flux, the bridge member 21 magnetically saturates depending upon its thickness and passes a limited magnetic flux below a predetermined amount determined by the saturation.

As explained above, in case that the gap between the stationary core 16 and the movable core 17 is large enough, and when a large amount of magnetic flux passes through the bridge member 21, a large magnetic traction force between the stationary core 16 and the movable core 17 is obtained, such that it is preferable to use a bridge member with a large thickness. Contrary, in case that the gap between the stationary core 16 and the movable core 17 is small and when the magnetic flux passing through the bridge member 21 is unduely large, the magnetic flux which serves to induce the magnetic traction force between the stationary core 16 and the movable core 17 reduces excessively.

Figure 4:
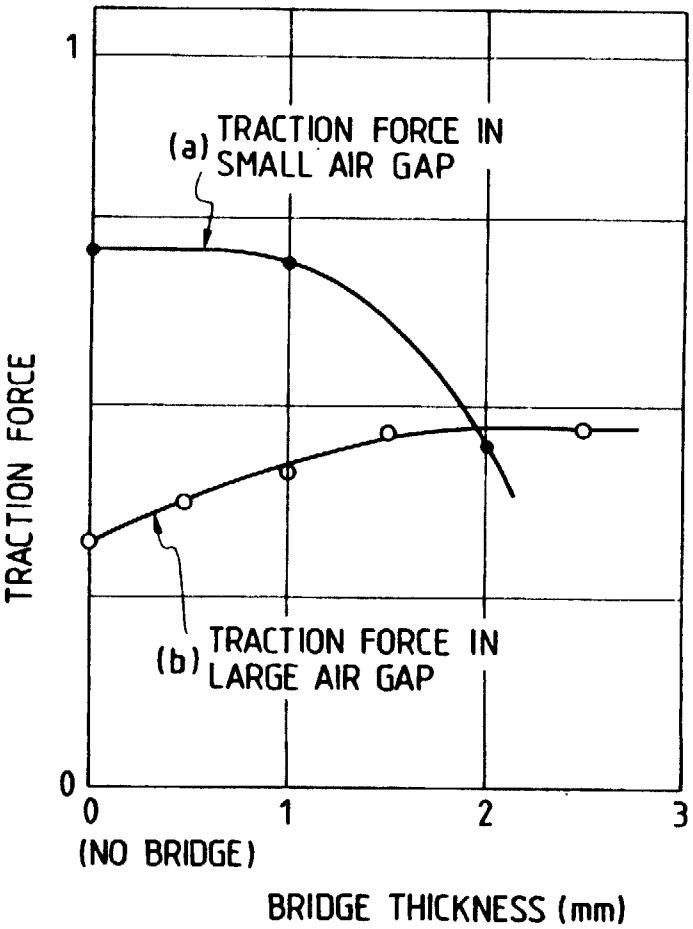
FIG. 4 is a graph showing a relationship between magnetic traction force and thickness of the bridge member in the first embodiment according to FIG. 1.

As shown by the curve (a) in FIG. 4, as the thickness of the bridge member 21 increases, the magnetic traction force in a small gap range between the stationary core 16 and the movable core 17 decreases, when the thickness of the bridge member 21 is increased more than 2 mm, the magnetic traction force unduely reduces to a practically inconvenient level. Further, as shown by the curve (b) in FIG. 4, as the thickness of the bridge member 21 decreases, the magnetic traction force in a large gap range between the stationary core 16 and the movable core 17 decreases, the thickness of bridge member 21 is decreased less than 1 mm, the magnetic traction force likely unduely reduces to a practically inconvenient level.

As will be apparent from the above, the practicable thickness of the bridge member 21 is in a range from 1 mm to 2 mm, and the bridge member thickness of 1.5 mm is preferable.

Now, the effects of the protrusion length of the bridge member 21 is explained. The abscissa in FIG. 25 indicates the bridge member protrusion rate as expressed by the following equation (1).

$$\text{Protrusion rate} = \frac{\text{Bridge protrusion length}}{\text{Distance from magnetic pole of stationary core to movable core}} \quad (1)$$

The bridge member protrusion length is the distance from the top of the movable core 17 to the top of the bridge member 21 when the movable core is fully opened. Further the distance from the movable core 17 to the stationary core 16 is measured in the magnetic flux passing direction. The ordinate in FIG. 5 indicates the magnetic traction force acting between the stationary core 16 and the movable core 17 when electric current begins to flow into the electromagnetic coil 18 in response to turn on of the engine start switch. Wherein the electromagnetic traction force when the protrusion rate is zero (no bridge member is included) is assumed 1.

Figure 5:
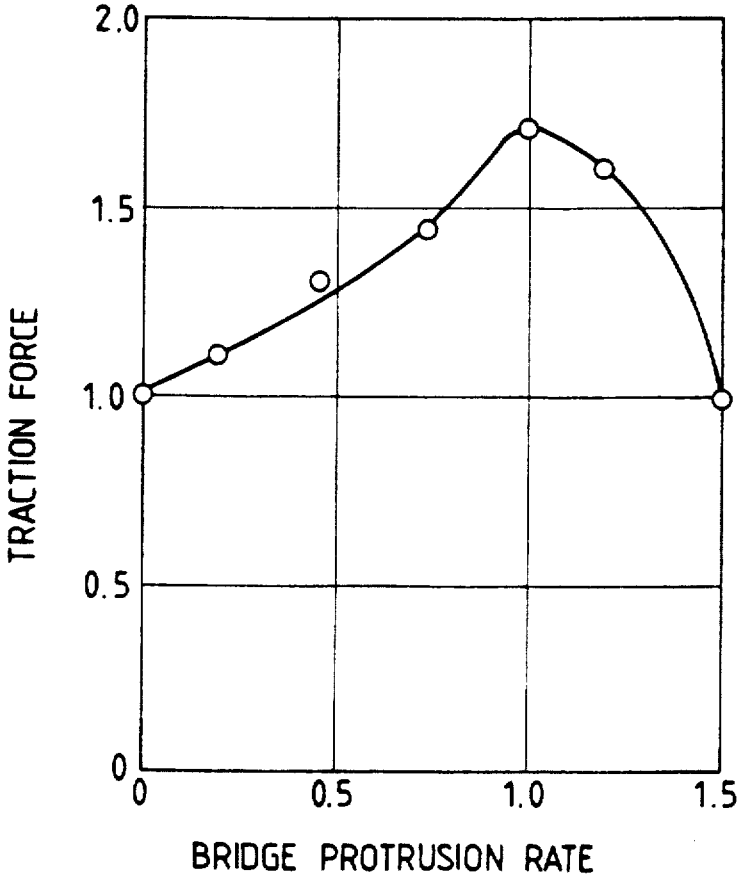
FIG. 5 is a graph showing a relationship between magnetic traction force and protrusion rate of the bridge member in the starter device according to FIG. 1 with FIG. 5A showing a movable core and bridge member and FIG. 5B showing a magnetic pole related thereto.
Figure 5A:
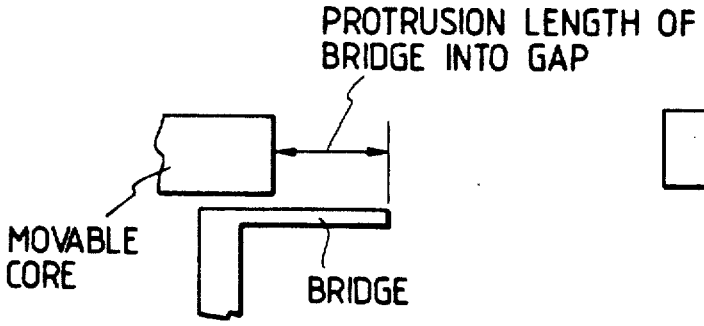
Figure 5B:
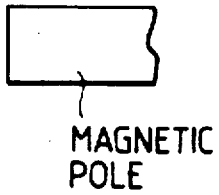

As will be understood from FIG. 5, initially, when the bridge member protrusion rate increases from 0, in association therewith the magnetic traction force increases. Namely, if there is any bridge protrusion, such is surely effective to increase the magnetic traction force. Further, the magnetic traction force increases as the bridge protrusion rate increases and reaches to the maximum value when the bridge protrusion rate becomes 1 (in that the top of the bridge member 21 substantially reaches to the magnetic pole 19 of the stationary core 16). When the bridge protrusion rate further increases (which means increase of overlapping portion of the bridge member 21 with the stationary core 16) and reaches to 1.5, the electromagnetic traction force thereat becomes equal to that of the bridge member 21 with zero protrusion rate, moreover as the bridge protrusion rate further increases, the magnetic traction force further descreases.

From the above observation, it is understood that the bridge protrusion rate is preferably restricted below 1.5 times of the maximum gap between the magnetic poles of the stationary core 16 and the movable core 17.

FIG. 6 shows second embodiment of the present invention, for facilitating the understanding thereof, only the electromagnetic push-out unit is taken out and illustrated. The elements brearing the same numerals as in FIG. 1 are the same members or constituents performing the similar operations as those in FIG. 1 so that the explanation thereof is omitted. In the present embodiment, one different point from the unit in FIG. 1 is that the bridge member 21 is constituted integrally with the movable core 17. The bridge member 21 is indeed slightly offset into the radial direction so as not to touch the top of the bridge member 21 to the magnetic pole 19 when the movable core 17 is displaced into the right ward direction. In this embodiment, the bridge member 21 is formed at the same time with the movable core 17, thereby, a separate fixing step of the bridge member 21 to the cylindrical member 12 is omitted.

FIG. 7 shows third embodiment of the present invention. Likly only the electromagnetic push-out unit 15 is taken out and illustrated, the other constitutions not shown are the same as those in FIG. 1. In the drawing, the elements bearing the same numerals are the same members or constituents performing the same operations as those illustrated in the previous embodiments so that the explanation thereof is omitted. In the present embodiment, one different point from the unit in FIG. 1 is that the bridge member 21 is disposed at the top end of the magnetic pole 19. Of course, the bridge member 21 is slightly offset in the radial direction so as not to touch to the movable core 17 when the movable core 17 comes close to the magnetic pole 19 by the magnetic traction force. In this embodiment, a particular measure to fix the bridge member 21 to the cylindrical member 12 is omitted, moreover, the bridge member 21 is fixed to the magnetic pole 19 on the stationary member other than the movable member, the fixing method is simplified and as well reliability such as in connection with mechanical strenght is improved. Further, the bridge member 21 may be formed integrally together with the stationary magnetic pole 19.

FIG. 8 is fourth embodiment of the present invention wherein only the electromagnetic push-out unit 15 is taken out and illustrated, the other constituents not shown are as same as those shown in FIG. 1 and further, in the drawing, the same reference numerals as in the previous drawings indicate the same members or constituents performing the same operations as in the previous embodiments so that the explanation thereof is omitted.

In the present embodiment, one different point from the unit in FIG. 1 is that the bridge member 21 is disposed at the top end of the movable core 17 as well as constituted by two portions 21*a* and 21*b* having different permeabilities. Namely, in this instance, the portion 21*b* near the movable core 17 is formed of a low permeability material such as non-magnetic material and synthetic resin and the other portion 21*a* near the magnetic pole 19 formed of a high permeability material, a similar material to the movable core 17, such as iron. A slightest protrusion of the low permeability material portion 21*b* into the gap from the top end of the movable core 17 is satisfactory and further the front portion of the bridge member 21 formed by the high permeability material 21*a* is constituted to have a portion which overlaps with the magnetic pole 19 into the axial direction when the gap is fully opened. Still further, the entire bridge member indeed is secured to the movable core 17 with a step so as to maintain a slight gap into radial direction with respect to the magnetic pole 19 even when the movable core 17 comes close to the magnetic pole 19 by the magnetic traction force. In this embodiment, even when the movable core 17 successively comes close to the magnetic pole 19 by the magnetic traction force, the interval between the top of the movable core 17 and the high permeability material portion 21*a* is always kept constant and the overlapping portion of the magnetic pole 19 with the high permeability material portion 21*a* only increases. Therefore, in the present embodiment, reduction of the magnetic traction force, when the gap distance is reduced, is prevented unlike the embodiment shown in FIG. 1. Further, in place of disposing the bridge member 21 at the top of the movable core 17, the bridge member 21 may be constituted to be secured to the cylindrical member 12 as in FIG. 1.

Figure 9:
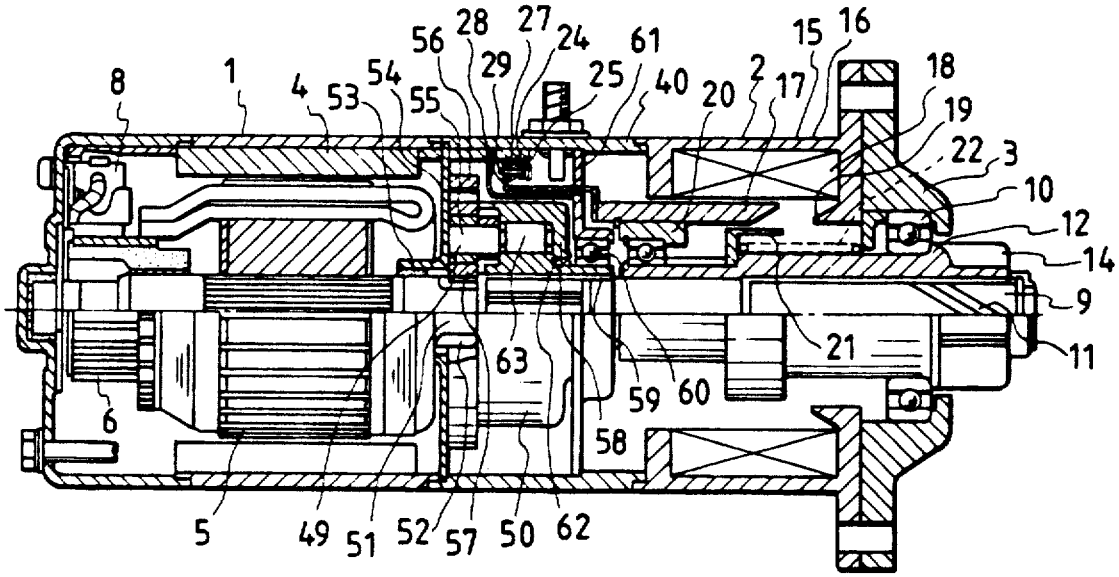
FIG. 9 is a view showing a starter device with a reduction mechanism according to the present invention.

FIG. 9 shows fifth embodiment of the present invention which illustrates a starter device provided with a reduction mechanism. Further, in the drawing, the same elements as in FIG. 1 are indicated with the same reference numerals as in FIG. 1. In this embodiment, a clutch side housing 40 is provided between the motor side housing 1 and the electromagnetic coil side housing 2, and in the clutch side housing 40 a planetary reduction gear mechanism 49 and a one way clutch 50 are accommodated.

At the front end of an armature shaft 51 of the armature 5 an armature gear 52 is provided. The armature shaft 51 is supported by a center bracket 54 via a bearing 53. A planetary gear 55 at its inside couples with the armature gear 52 and at its outside couples with an internal gear 56. At the axial center portion of the planetary gear 55 a sprocket 57 is provided. To one end of the sprocket 57 is secured a clutch outer 58, and the rotating force of the planetary gear 55 received by the armature gear 52 is transmitted to the clutch outer 58 via the sprocket 57.

A clutch inner 59 provided at the rear end of the pinion shaft 9 is supported by a center bracket 61 via a ball bearing 60.

Between the clutch outer 58 and the clutch inner 59 an outer metal 62 is pressed in thereby to support the clutch outer 58 and the clutch inner 59 each other. The rotating force of the clutch outer 58 is transmitted to the clutch inner 59 via rollers 63 to rotate the pinion shaft 9.

In this embodiment, the one way clutch 50 and the planetary reduction gear mechanism unit 49 are integrated and disposed between the armature 5 and the electromagnetic push-out unit 15 such that the number of constituent parts is reduced. The switch 24 is disposed in the space between the one way clutch 50 and the clutch side housing 40 so that the lenght in axial direction of the starter device is shortened to thereby reduce the size thereof in comparizson with the conventional starter device in which the constituent elements are arranged successively in the order of the motor, planetary reduction gear, contactor unit, electromagnetic push-out unit, one way clutch and pinion gear in the axial direction.

Further, the bridge member 21 is provided inside the electromagnetic coil 18 so that many magnetic elements within the starter device are isolated from the electromagnetic coil 18, wherein the electromagnetic coil side housing 2 is formed of non-magnetic material, and magnetic flux leakage is reduced. Therefore, the thickness of the bridge member is reduced and the space for the starter device is effectively utilized.

Figure 10:
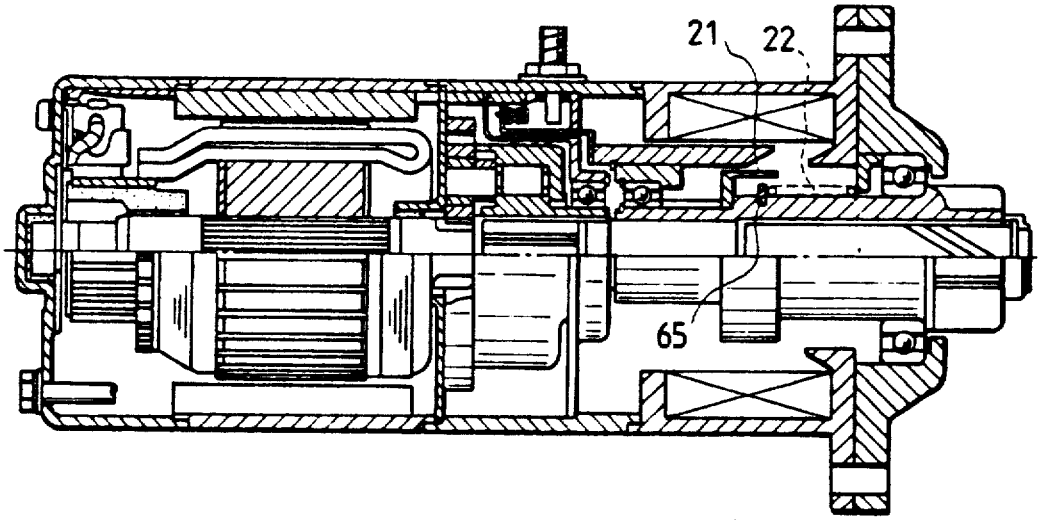
FIG. 10 is a view showing another starter device according to the present invention.

FIG. 10 shows sixth embodiment of the present invention, the pressing force of the return spring 22 is supported by a stopper key 65. With this constitution, no pressing force is anymore applied to the bridge member 21 so that distortion of the bridge member 21 is avoided.

Figure 11:
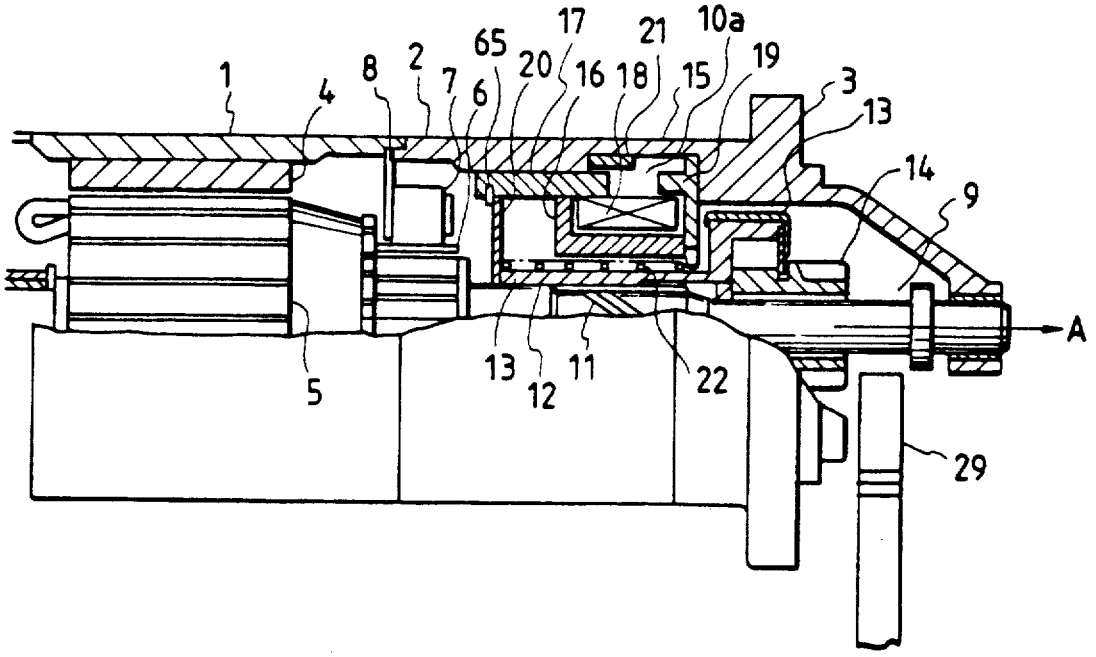
FIG. 11 is a view showing a further starter device according to the present invention.

FIG. 11 shows seventh embodiment of the present invention, wherein the same reference numerals as in FIG. 1 indicate the same elements as in FIG. 1, and further the switch 24 is not illustrated. Characteristics in this embodiment reside in the constitution of the electromagnetic push-out unit, and the other constitutional portions are substantially the same as those in FIG. 1. Therefore, the electromagnetic push-out unit 15 is principally explained hereinbelow.

The bridge member 21 made of magnetic material which constitutes a magnetic bypass circuit is secured around the inner circumferential face of the electromagnetic coil side housing 2 near the top end of the movable core 17. Further the bridge member 21 is disposed in such a manner that one end thereof at least overlaps with the movable core 17 and the other end thereof is located so as not to overlap with the top end of the magnetic pole 19 of the stationary core 16, of which detail will be explained later.

The movable core 17 is coupled to the cylindrical member 12 via the coupling plate 20 and a snap ring 65 so as to smoothly move along the pinion shaft 9. Further, the electromagnetic coil side housing 2 is constituted by non-magnetic material, and the movable core 17 is slidably fitted on the inner face of the electromagnetic coil side housing 2.

When electric current is supplied to the electromagnetic coil 18 in the electromagnetic push-out unit thus constituted, a magnetic flux path is formed via the stationary core 16, stationary magnetic pole 19, air gap 10*a* and movable core 17, and a magnetic traction force is induced which acts in the direction for reducing the gap lenght between the stationary core 16 and the movable core 17 (the rightward direction in the drawing). In this instance, since the bridge member 21 made of the magnetic material is disposed near the outer circumference of the top end of the movable core 17, a part of the magnetic flux induced by the electromagnetic coil 18 is conveyed to the magnetic pole 19 via the bridge member 21 having a small magnetic resistance. The reduction of magnetic resistance via the bridge member 21 is equivalent to the reduction of gap distance between the stationary core 16 and the movable core 17 so that the electromagnetic traction force is increased in comparison wiht the electromagnetic push-out unit without the bridge member 21. In this embodiment, the distance between the bridge member 21 and magnetic pole 19 of the stationary core 16 is unchanged even when the movable core 17 successively comes close to the magnetic pole 19 by the magnetic traction force, therefore when the top end of the bridge member 21 is located near the top end of the magnetic pole 19 of the stationary core 16, the electromagnetic push-out unit 15 always operates under the maximum electromagnetic traction force in combination with that of the bridge member 21 without being affected by the displacement of the movable core 17. Accordingly, the size and weight of the constituent elements which are required to generate a predetermined electromagnetic traction force are reduced in comparison with the conventional starter device and further the power consumption of the present starter device is reduced.

Figure 12:
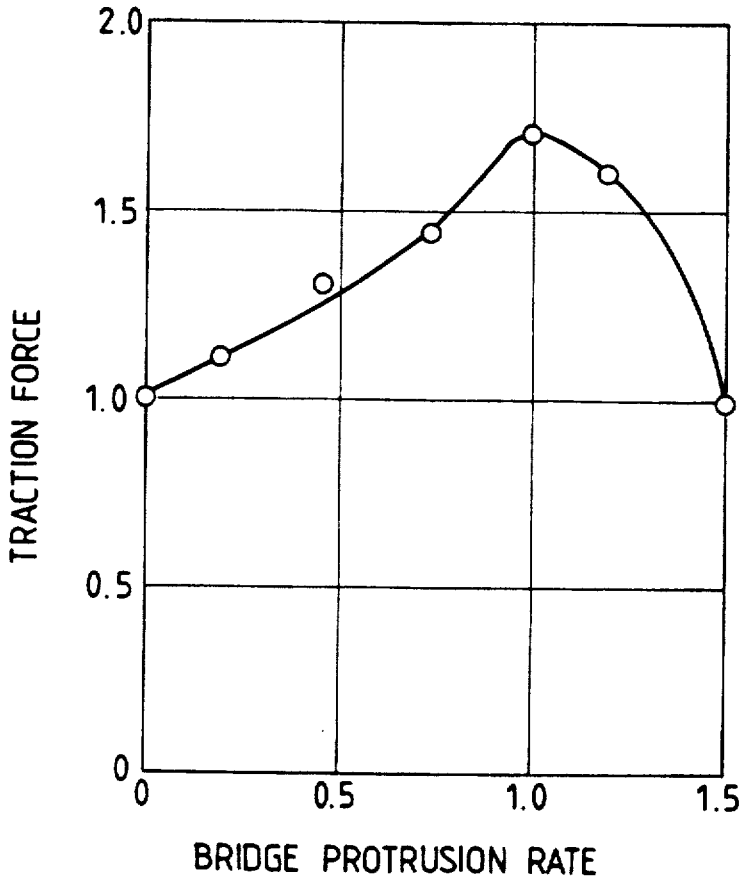
FIG. 12 is a graph showing a relationship between magnetic traction force and protrusion rate of the bridge member in the starter device in FIG. 11 with FIG. 12A showing a movable core and bridge member and FIG. 12B showing a magnetic pole related thereto.
Figure 12A:
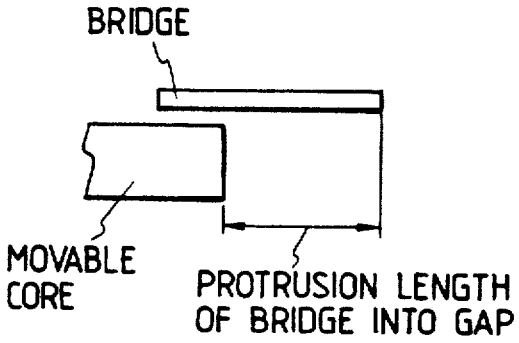
Figure 12B:
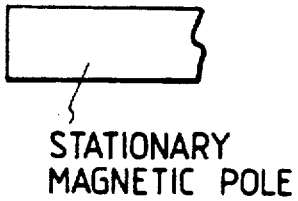

FIG. 12 shows a relationship between electromagnetic traction force acting between the stationary core 16 and the movable core 17 when electric current is supplied to the electromagnetic coil 18 in response to turn on of the engine start switch, and bridge protrusion rate. As will be apparent from FIG. 12, with the present embodiment substantially the same result as that in FIG. 1 is obtained.

Figure 13:
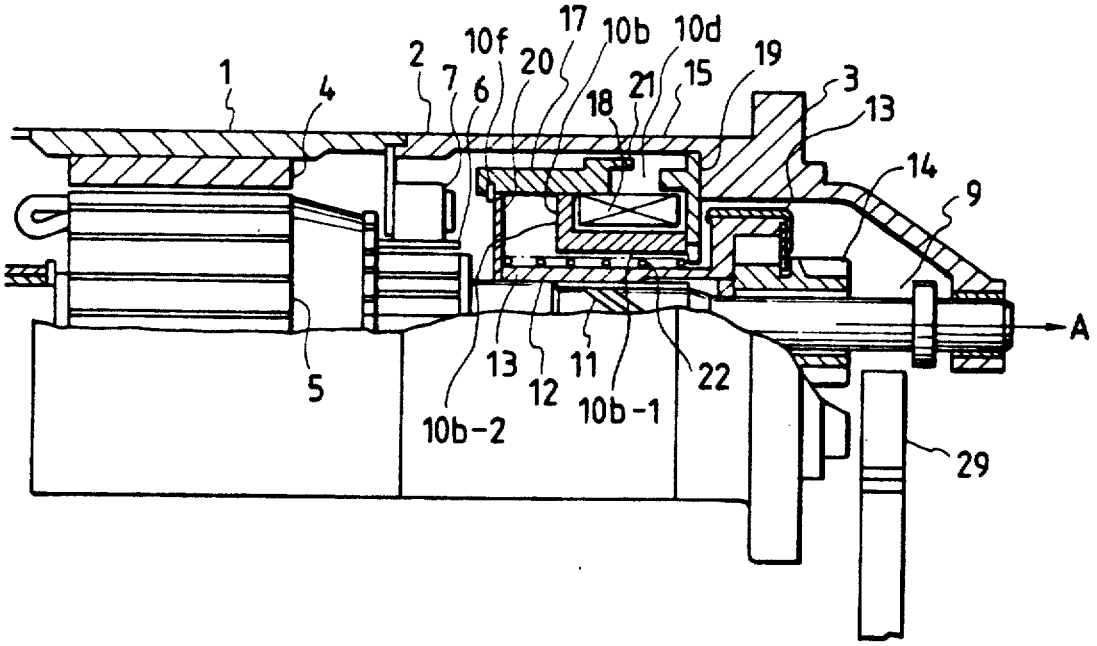
FIG. 13 is a view showing another starter device according to the present invention.

FIG. 13 shows eighth embodiment of the present invention wherein the same reference numerals as those in FIG. 11 designate the same members or constituents performing the same operations as those in FIG. 11 such that the explanation thereof is omitted. The different points of the present embodiment from that shown in FIG. 11 are that the bridge member 21 is formed integrally with the movable core 17 at the outer circumferential end of the movable core 17. In this embodiment, in accordance with the displacement of the movable core 17 the bridge member 21 displaces so that when the gap lenght decreases the magnetic traction force decreases because of the overlap of the top end portion of the bridge member with the magnetic pole 19 of the stationary core 16. In the present embodiment, like the previous embodiments, the increase of magnetic traction force, when the movable core 17 comes close to stationary core 16, is suppressed by the bridge member 21 and is enhanced when the gap distance is large via the bridge member 21, thereby the level of mechanical strength of the constituent elements of the electromagnetic push-out unit is reduced while maintaining enough magnetic traction force when the gap distance is large so that the entire size of the electromagnetic push-out unit is reduced. Further in the present embodiment the structure of the bridge member 21 is simplified and the additional processing of the housing 2 is also eliminated.

We claim:

1. A starter device comprising an electric motor, a pinion shaft mechanically coupled to the shaft of said electrical motor, a pinion gear to which the rotational movement of said electrical motor is transmitted via said pinion shaft, a ring gear for an engine disposed in an engagable relation with said pinion gear, the starter device further comprising a cylindrical member disposed concentrically with said pinion shaft and slidably with respect to said pinion shaft, said cylindrical member mechanically couples said pinion shaft and said pinion gear, and an electromagnetic push-out unit disposed outside said pinion shaft concentric therewith, said electromagnetic push-out unit controls engagement and disengagement between said pinion gear and said ring gear via axial movement of said cylindrical member and said electromagnetic push-out unit includes an electromagnetic coil, a stationary core for the electromagnetic coil, a movable core facing to the pole face of said stationary core with a first gap when no electric current is supplied to said electromagnetic coil, said movable core is mechanically coupled with said cylindrical member so as to permit axial displacement thereof, said stationary core and said movable core form a magnetic circuit via the first gap when electric current is supplied to said electromagnetic coil, and a bridge member magnetically coupled to one of said stationary core and said movable core and maintaining a second gap shorter than the first gap with respect to the other of said stationary core and said movable core when no electric current is supplied to said electromagnetic coil thereby a part of the magnetic flux induced in the magnetic circuit when electric current is supplied to said electromagnetic coil is bypassed through said bridge member.

2. A starter device according to claim 1, wherein the magnetic flux bypassing from the magnetic circuit initiates when said movable core displaces a predetermined distance toward said stationary core.

3. A starter device according to claim 1, wherein said bridge member is disposed at the outside of said electromagnetic coil.

4. A starter device according to claim 1, wherein said bridge member is disposed at the inside of said electromagnetic coil.

5. A starter device according to claim 1, wherein the thickness of said bridge member is more than 1 mm and is less than 2 mm.

6. A starter device according to claim 1, wherein the thickness of said bridge member is about 1.5 mm.

7. A starter device according to claim 1, wherein the top end position of said bridge member is determined so as to locate in the first gap between said stationary core and said movable core.

8. A starter device according to claim 1, wherein said bridge member is formed of two parts having different permeabilities along the displacing direction of the movable core.

9. A starter device according to claim 1, wherein said bridge member is a cylindrical shape.

10. A starter device according to claim 1, wherein said bridge member is made of magnetic material.

11. A starter device according to claim 1, wherein the rotating movement of said electric motor is transmitted to said pinion shaft after reducing the rotating speed via a speed reduction mechanism.

12. A starter device according to claim 1, wherein the bridge member is mechanically coupled to said cylindrical member.

13. A starter device according to claim 1, wherein said bridge member is mechanically coupled to one of said stationary core and said movable core.

14. A starter device according to claim 1, further comprising a return spring which biases said movable core away from said stationary core, the thickness of said bridge member and the protrusion rate of said bridge member into the first gap are determined such that the variation of reaction force in said return spring and the variation of magnetic traction force acting between said stationary core and said movable core in response to the variation of gap distance between said stationary core and said movable core is substantially the same.

15. A starter device according to claim 1, wherein said bridge member overlaps with the other of said stationary core and said movable core in the moving direction of said movable core without touching thereto when said movable core comes close to said stationary core thereby suppressing the increase of the magnetic traction force acting between said stationary core and said movable core.

16. A starter device comprising an electric motor, a pinion shaft mechanically coupled to the shaft of said electrical motor, a pinion gear to which rotational movement of said electrical motor is transmitted via said pinion shaft, a ring gear for an engine disposed in an engagable relation with said pinion gear, the starter device further comprising a cylindrical member made of non-magnetic material disposed concentrically with said pinion shaft and slidably with respect to said pinion shaft, said cylindrical member mechanically couples said pinion shaft and said pinion gear, and an electromagnetic push-out unit disposed outside said pinion shaft concentric therewith including a magnetic bypass member made of magnetic material, said electromagnetic push-out unit controls engagement and disengagement between said pinion gear and said ring gear via axial movement of said cylindrical member and said electromagnetic push-out unit includes an electromagnetic coil, a stationary core for the electromagnetic coil, a movable core facing to the pole face of said stationary core with a first gap when no electric current is supplied to said electromagnetic coil, said movable core is mechanically coupled with said cylindrical member so as to permit axial displacement thereof.

17. A starter device including a pinion gear, a pinion shaft for rotating said pinion gear and an electromagnetic push-out unit for displacing said pinion gear into its thrust direction, said pinion gear and said electromagnetic push-out unit are disposed concentrically with respect to said pinion shaft characterized in that, a magnetic bypass member made of magnetic material is provided near an air gap in a magnetic circuit formed by a stationary core and a movable core in said electromagnetic push-out unit.

* * * * *